US006719290B1

(12) United States Patent
Kershner

(10) Patent No.: US 6,719,290 B1
(45) Date of Patent: Apr. 13, 2004

(54) STORYTELLING AND IDEA GENERATION GAME

(76) Inventor: Kristina Kershner, 1960-B 40th St., Los Alamos, NM (US) 87544

( * ) Notice: Subject to any disclaimer, the term of this patent is extended or adjusted under 35 U.S.C. 154(b) by 34 days.

(21) Appl. No.: 10/075,057

(22) Filed: Feb. 11, 2002

Related U.S. Application Data

(60) Provisional application No. 60/267,655, filed on Feb. 9, 2001.

(51) Int. Cl.[7] ..... A63F 5/04

(52) U.S. Cl. ..... 273/272; 273/142 HA

(58) Field of Search ..... 273/142 R, 142 E, 273/142 F, 142 G, 142 H, 142 HA, 144 B, 272

(56) References Cited

U.S. PATENT DOCUMENTS

| | | | | | |
|---|---|---|---|---|---|
| 259,920 | A | | 6/1882 | Reiff | |
| 629,046 | A | | 7/1899 | Osman | |
| 636,508 | A | | 11/1899 | Eickershoff | |
| 894,274 | A | | 7/1908 | Lockwood | |
| 1,581,923 | A | | 4/1926 | Frome | |
| 1,892,664 | A | | 1/1933 | Eyles | |
| 2,081,255 | A | * | 5/1937 | Troth | 273/142 F |
| 2,150,303 | A | | 3/1939 | Walker | |
| 2,215,696 | A | | 9/1940 | Graves, Jr. | |
| 2,370,229 | A | | 2/1945 | Buckley | |
| 3,143,347 | A | * | 8/1964 | Ruderian | 273/147 |
| 3,163,426 | A | * | 12/1964 | Ruderian | 273/142 R |
| 3,355,172 | A | | 11/1967 | Aukens | |
| 3,640,531 | A | | 2/1972 | Penders | |
| 3,762,071 | A | | 10/1973 | Coffman et al. | |
| 3,810,628 | A | * | 5/1974 | Vigan | 273/142 HA |
| 4,163,556 | A | * | 8/1979 | Bertin | 463/67 |
| 4,452,455 | A | | 6/1984 | Bergstrom et al. | |
| 4,601,407 | A | * | 7/1986 | Gillard | 229/125.19 |
| 4,601,470 | A | * | 7/1986 | Kadota et al. | |
| 4,666,160 | A | * | 5/1987 | Hamilton | 273/242 |
| 4,674,748 | A | | 6/1987 | Wismer | |
| 4,941,665 | A | | 7/1990 | Klamer | |
| 5,100,140 | A | | 3/1992 | Foy | |
| 5,232,222 | A | | 8/1993 | Deutch | |
| 5,340,105 | A | | 8/1994 | Gostyla | |
| 5,553,851 | A | * | 9/1996 | Malavazos et al. | 273/142 E |
| 5,657,992 | A | | 8/1997 | Bellizzi | |
| 6,059,290 | A | | 5/2000 | Neil | |

* cited by examiner

*Primary Examiner*—William M. Pierce
(74) *Attorney, Agent, or Firm*—Jeffrey D. Myers

(57) ABSTRACT

A group interaction method comprising: randomly selecting a plurality of indicia; requiring a first set of one or more persons to generate one or more texts containing words corresponding to the plurality of indicia; and having a second set of one or more other persons record one or more words that one or more of the first set is likely to use in one or more of the texts.

14 Claims, 8 Drawing Sheets

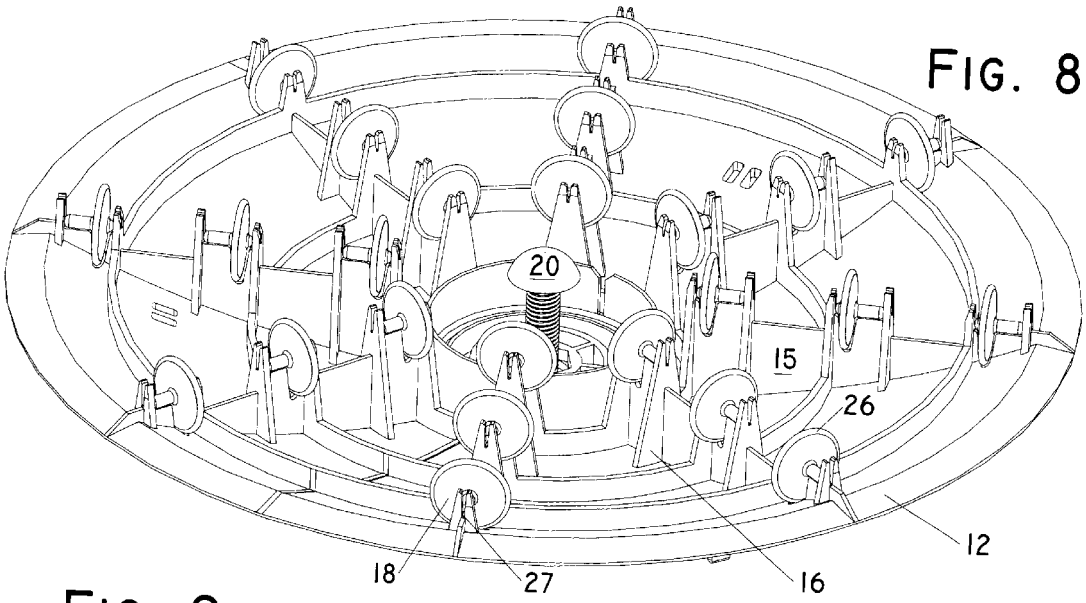
FIG. 8
FIG. 9
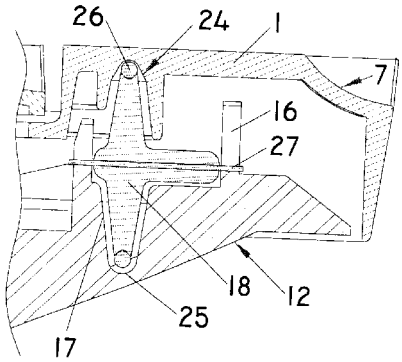
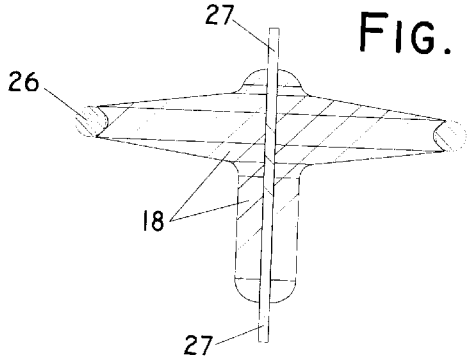
FIG. 12
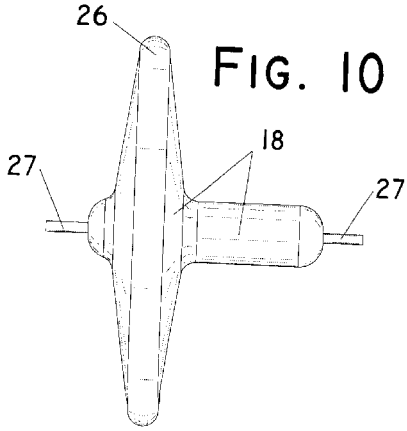
FIG. 10
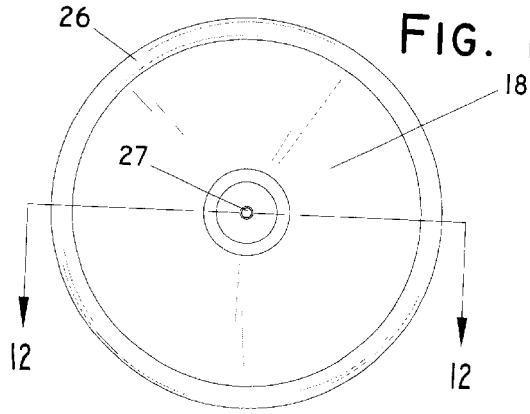
FIG. 11

STORYTELLING AND IDEA GENERATION GAME

CROSS-REFERENCE TO RELATED APPLICATIONS

This application claims the benefit of the filing of U.S. Provisional Patent Application Serial No. 60/267,655, entitled "Random Generator Object With Spinning Concentric Wheels", filed on Feb. 9, 2001, and the specification thereof is incorporated herein by reference.

COPYRIGHTED MATERIAL

A portion of the disclosure of this patent document and of the related application listed above contains material that is subject to copyright protection. The owner has no objection to the facsimile reproduction by anyone of the patent document or the patent disclosure, as it appears in the Patent and Trademark Office patent file or records, but otherwise reserves all copyrights whatsoever.

BACKGROUND OF THE INVENTION

1. Field of the Invention (Technical Field)

The present invention relates to game apparatuses and methods for stimulating and enhancing storytelling and idea generation (e.g. brainstorming, therapy, employee training and teaching).

2. Background Art

The following are illustrative of prior art apparatuses and methods arguably related to the present invention: U.S. Pat. No. 6,059,290, to Neil, entitled "Board Game"; U.S. Pat. No. 5,657,992, to Bellizzi, entitled "Entertainment Device and Method for Developing Acting, Thinking, Writing and Public Speaking Ability"; U.S. Pat. No. 5,340,105, to Gostyla, entitled "Counter Rotating Pointer and Disc Chance Device"; U.S. Pat. No. 5,232,222, to Deutch, entitled "Random Number Selector Device and Method"; U.S. Pat. No. 5,100,140, to Foy, entitled "Wheel of Black History Game Device"; U.S. Pat. No. 4,941,665, to Klamer, entitled "Rotator Game Device"; U.S. Pat. No. 4,674,748, to Wismer, entitled "Method and Means for Randomly Selecting a Plurality of Groups of Numbers"; U.S. Pat. No. 4,452,455, to Bergstrom et al., entitled "Puzzle Game"; U.S. Pat. No. 4,163,556, to Bertin, entitled "Varied Track Advancement Game Mechanism"; U.S. Pat. No. 3,762,071, to Coffman et al., entitled "Teaching Aid"; U.S. Pat. No. 3,640,531, to Penders, entitled "Word Forming Game Device"; U.S. Pat. No. 3,355,172, to Aukens, entitled "Word Game"; U.S. Pat. No. 2,370,229, to Buckley, entitled "Game Apparatus"; U.S. Pat. No. 2,215,696, to Graves, Jr., entitled "Game Apparatus"; U.S. Pat. No. 2,150,303, to Walker, entitled "Game"; U.S. Pat. No. 1,892,664, to Eyles, entitled "Spinning Game"; U.S. Pat. No. 1,581,923, to Frome, entitled "Educational Appliance"; U.S. Pat. No. 894,274, to Lockwood, entitled "Educational Toy"; U.S. Pat. No. 636, 508, to Eickershoff, entitled "Game Board"; and U.S. Pat. No. 629,046, to Osman, entitled "Educational Appliance".

SUMMARY OF THE INVENTION (DISCLOSURE OF THE INVENTION)

The present invention is of a group interaction method comprising: randomly selecting a plurality of indicia; requiring a first set of one or more persons to generate one or more texts containing words corresponding to the plurality of indicia; and having a second set of one or more other persons record one or more words that one or more of the first set is likely to use in one or more of the texts. In the preferred embodiment, the method additionally comprises randomly selecting a scenario within which the one or more texts must fall, preferably from a plurality of scenario cards. The indicia (preferably words) are preferably presented by employing a concentric-ring apparatus with a plurality of rings bearing indicia or a set of cards bearing indicia. The "likely" words preferably may not contain any of a predetermined list of words.

The invention is also of a concentric-ring apparatus comprising: a hub; a plurality of concentric wheels mounted around and spinnable about the hub; indicia on the wheels; and a timer mounted atop the hub. In the preferred embodiment, each of the wheels comprises one or more finger notches, the indicia are on rings removably attached to the wheels, and a base is employed comprising a plurality of bearings over which the wheels travel, the bearings comprising O-rings of a pliable material (preferably silicone). The apparatus employs a device (such as a bolt and various grooves and protrusions) for preventing the apparatus from disassembling when the apparatus is tipped or inverted. The bearings with O-Rings substantially eliminate noise when the wheels are spun about the hub. The timer is preferably a sand timer.

The invention is additionally of a concentric-ring apparatus comprising: a hub; a plurality of concentric wheels mounted around and spinnable about the hub; a base; and a plurality of bearings mounted in the base and over which the wheels travel, the bearings comprising O-rings of a flexible material. In the preferred embodiment, each of the wheels comprises one or more finger notches and the flexible material comprises silicone. The apparatus employs a device (such as a bolt and various grooves and protrusions) for preventing the apparatus from disassembling when the apparatus is tipped or inverted. The bearings with O-Rings substantially eliminate noise when the wheels are spun about the hub. The apparatus preferably additionally comprises indicia on the wheels and a timer mounted atop the hub, most preferably a sand timer.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings:

FIG. 8 is a top perspective view of the base and bearings of the preferred apparatus of the invention;

FIG. 9 is a section view of an in-place bearing of the preferred apparatus of the invention;

FIG. 10 is a side view of a bearing of the preferred apparatus of the invention;

FIG. 11 is an end view of a bearing of the preferred apparatus of the invention; and FIG. 12 is a section view of a bearing of the preferred apparatus of the invention.

Figure 1:
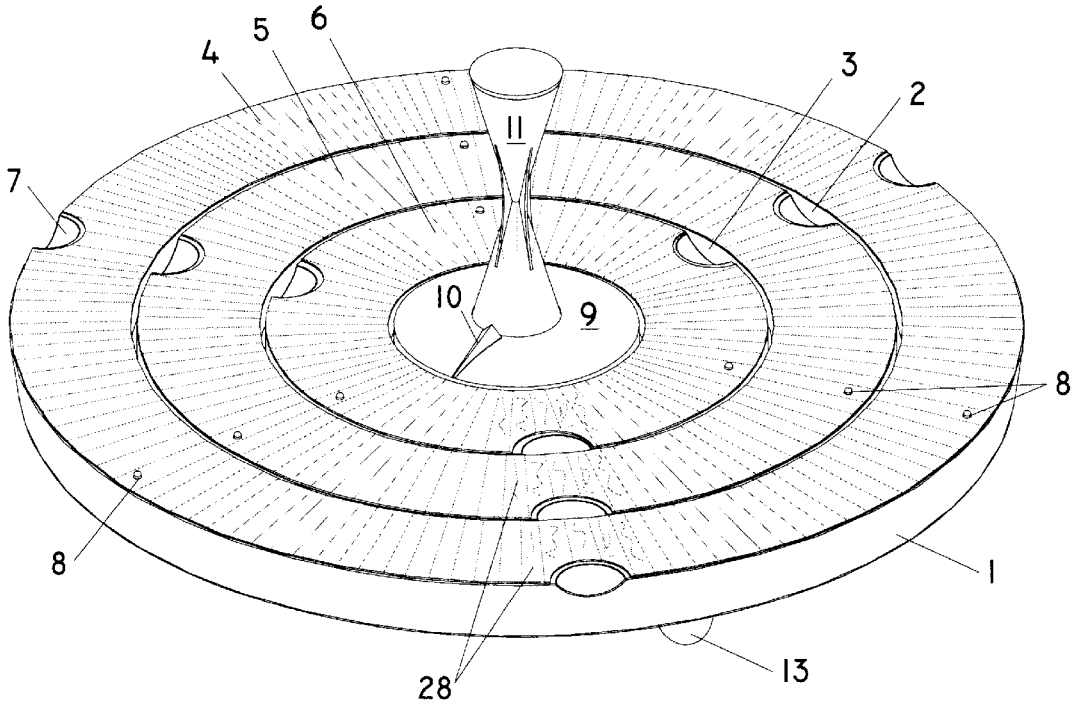
FIG. 1 is a top perspective view of the preferred apparatus of the invention.

The following reference numerals are used throughout the Figures:

1 Outer Wheel
2 Middle Wheel
3 Inner Wheel
4 Outer Indicia (e.g., Text and/or Graphics) Ring
5 Middle Indicia (e.g., Text and/or Graphics) Ring
6 Inner Indicia (e.g., Text and/or Graphics) Ring
7 Finger Notch
8 Nub (to secure Ring)
9 Center Cap
10 Pointer
11 Timer
12 Base
13 Foot
14 Barb (to secure Foot)
15 Structural Rib
16 Bearing Support Rib
17 Structural Rib Cutout for Bearing
18 Bearing
19 Bolt Cover
20 Bolt
21 Hexagonal Nut
22 Hexagonal Nut Receptacle
23 Center Cap Receptacle
24 Wheel Groove for Bearing
25 Base Groove for Bearing
26 O-Ring
27 Axle
28 Text/Graphics (e.g., Text and/or Graphics)
29 Finger Notch Cutout
30 Nub Cutout
31 Pointer Key Slot
32 Press Fit Rib
33 Pointer Key
34 Timer Body
35 Timer Endcap
36 Timer Structural Rib
37 Center Cap Key
38 Center Cap Key Slot
39 Wheel Nesting Shelf

DESCRIPTION OF THE PREFERRED EMBODIMENTS (BEST MODES FOR CARRYING OUT THE INVENTION).

Figure 2:
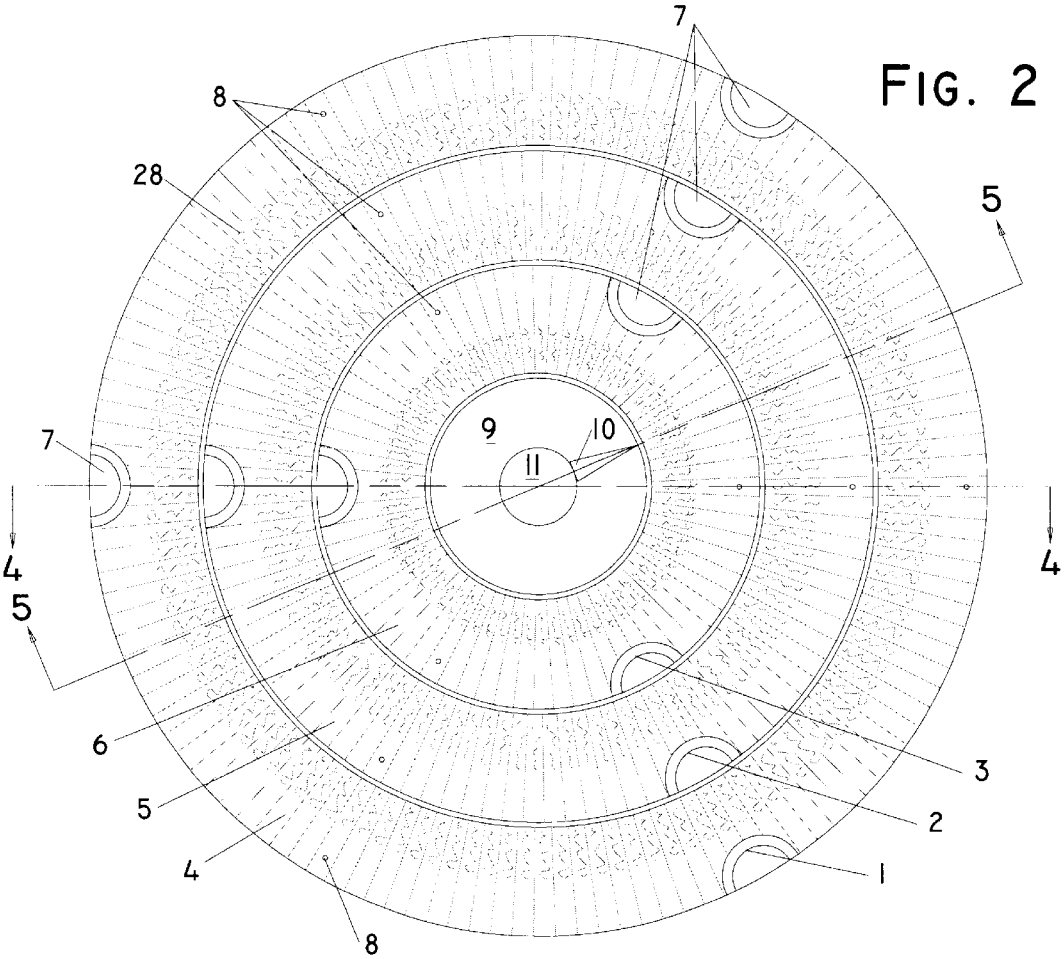
FIG. 2 is a top view of the preferred apparatus of the invention.
Figure 3:
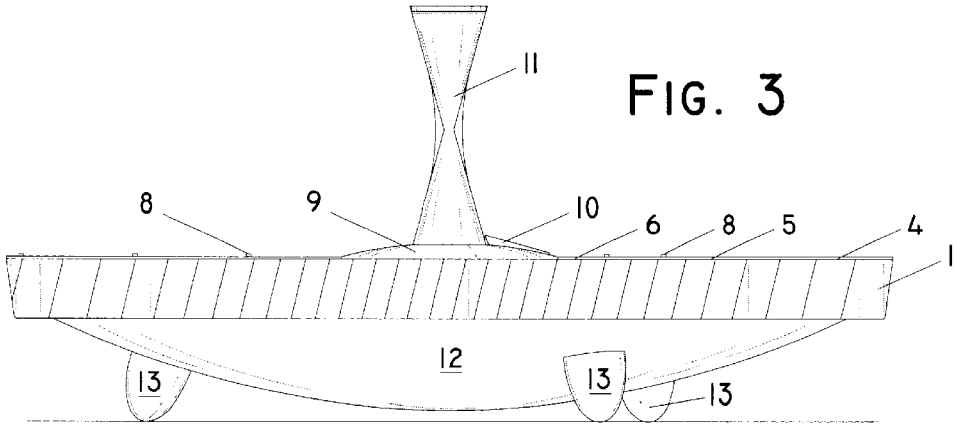
FIG. 3 is a side view of the preferred apparatus of the invention.
Figure 4:
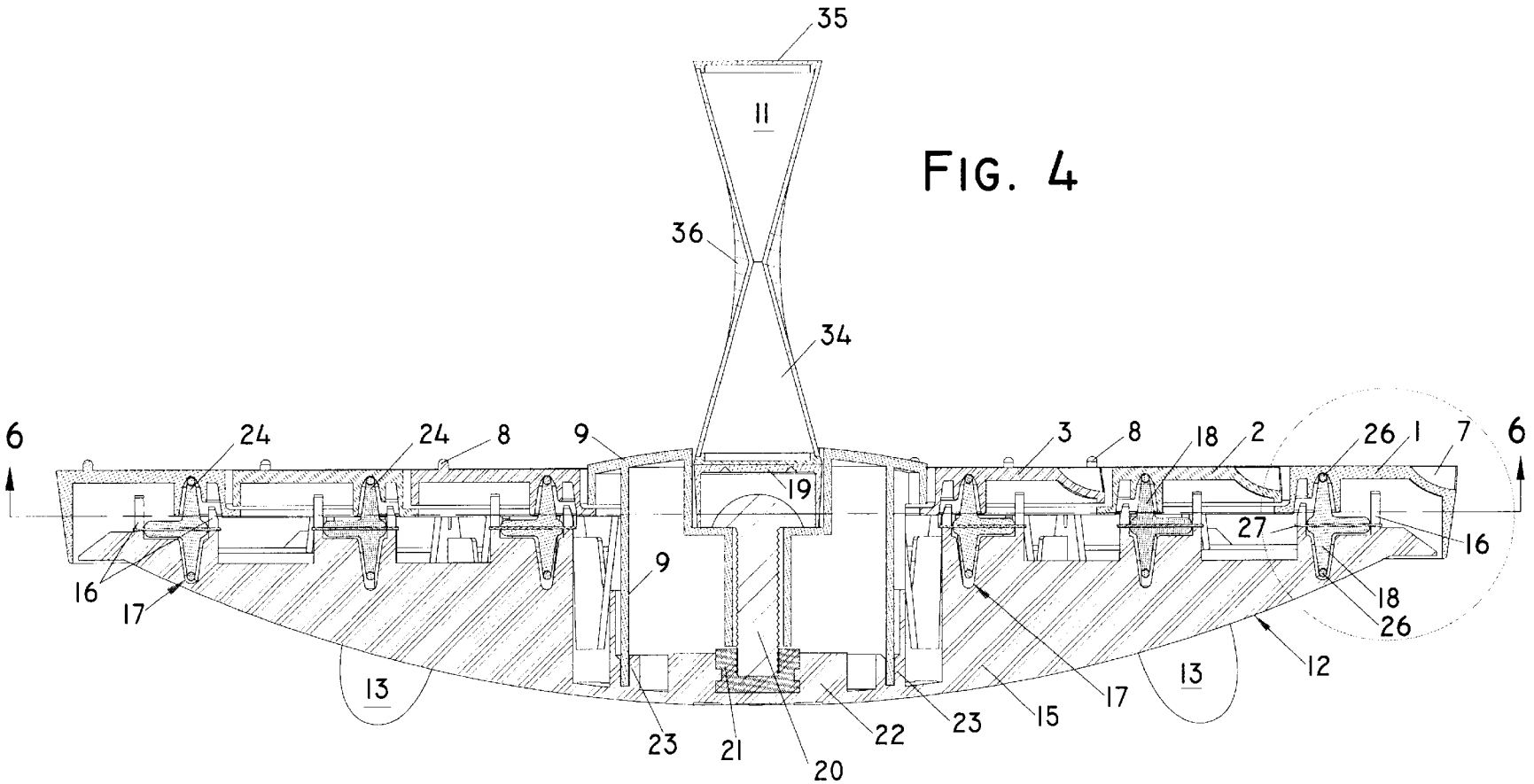
FIG. 4 is a side section view of the preferred apparatus of the invention through its center.
Figure 5:
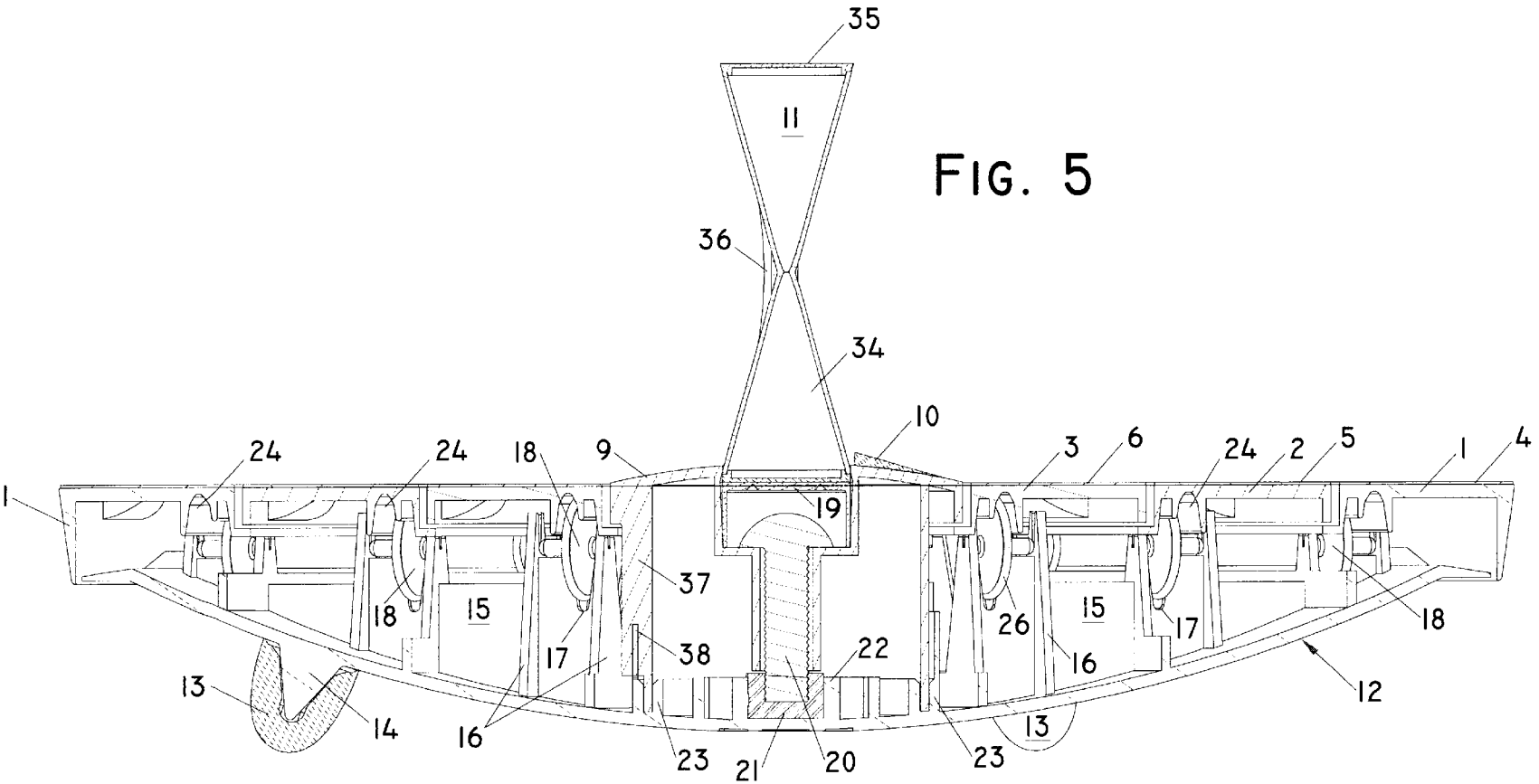
FIG. 5 is a side section view of the preferred apparatus of the invention showing in perspective view the bearings of the invention.
Figure 6:
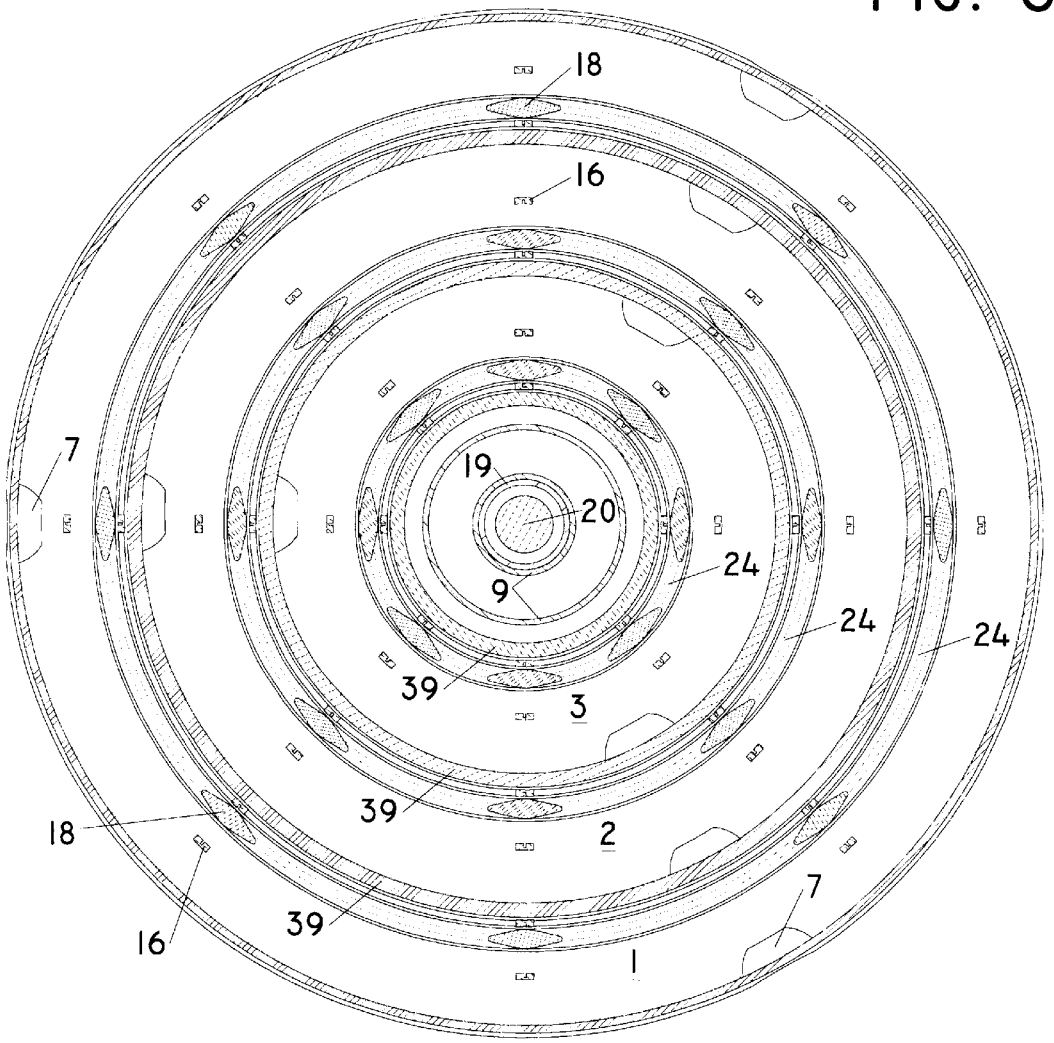
FIG. 6 is a top section view of the preferred apparatus of the invention.
Figure 7A:
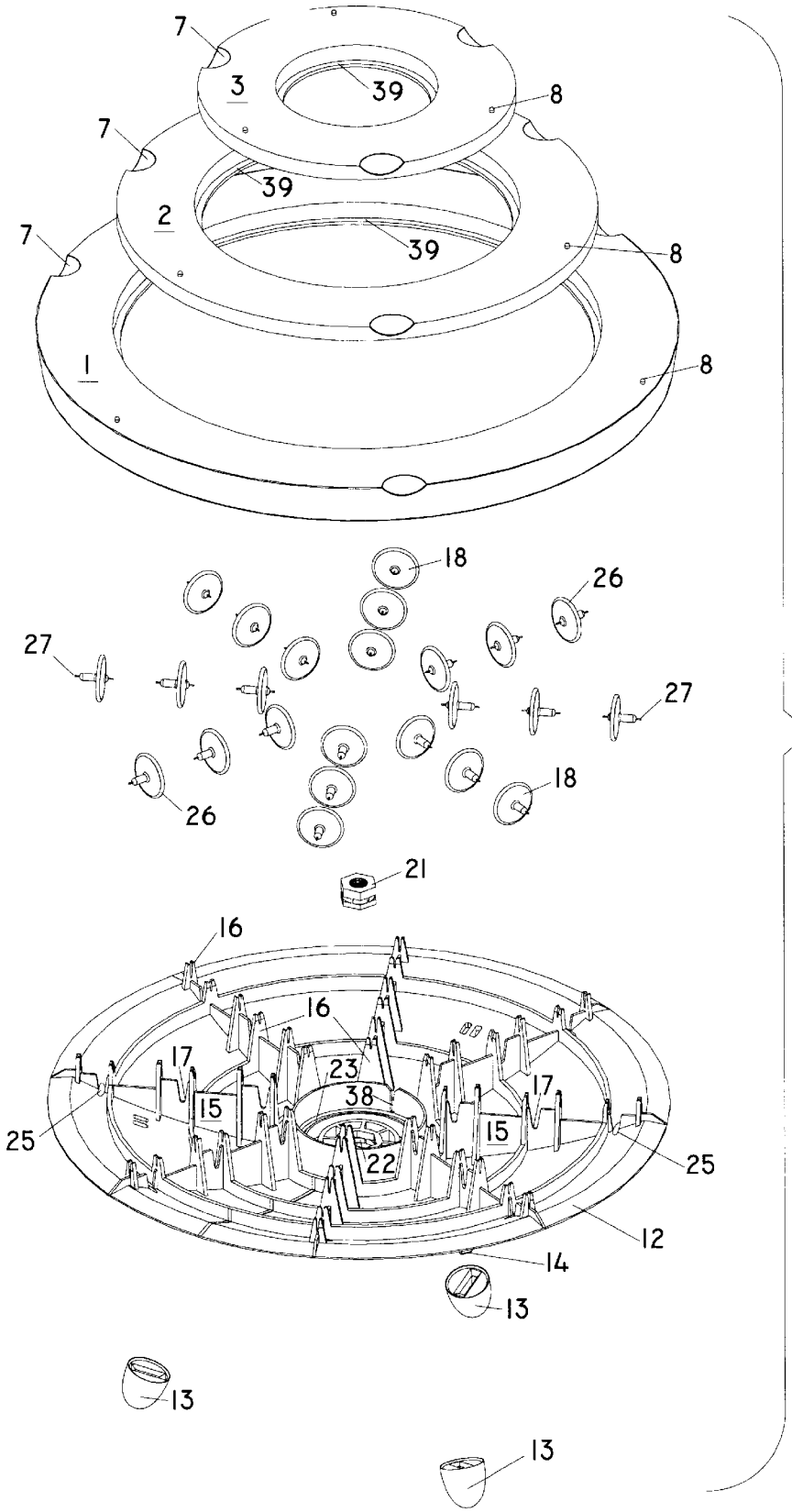
FIG. 7A is an exploded assembly view of the base, bearings, and rings of the preferred apparatus of the invention.
Figure 7B:
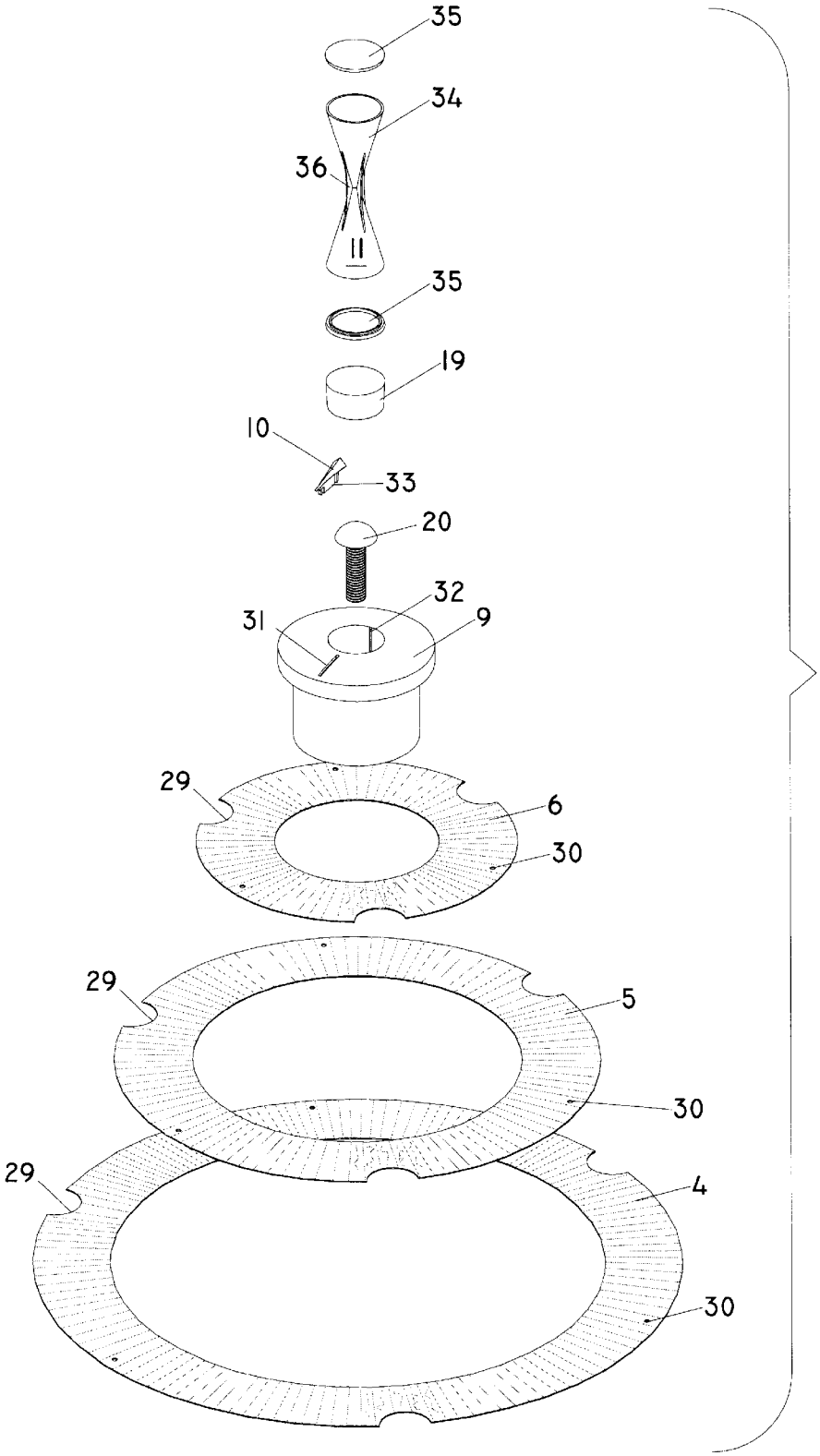
FIG. 7B is an exploded assembly view of the indicia bearing rings, timer base, and timer of the preferred apparatus of the invention.

The present invention is of a storytelling game method, a concentric-ring apparatus supporting the method, and a novel bearing system for concentric-ring apparatuses. The apparatus and bearings will be described with reference to FIGS. 1–12, followed by a description of the preferred method of the invention. The invention can be used for a variety of purposes, including as a:

storytelling device
idea generator
brainstorming tool
employee training tool
therapy tool
writer's tool
teaching tool
public speaking tool
language learning tool
icebreaker The concentric-ring apparatus of the invention is a random generator (called "G") of words, ideas, persons, places, things, and times (days, months, years, centuries, etc.). It comprises wheels 1, 2, 3 that spin around a center hub/cap 9, rings 4, 5, 6 adorned with text and/or graphics that sit on top of the wheels, a base 12, and a timer 11.

The wheels preferably have small nubs 8. The rings have small "receiving" holes which line up with the nubs on the wheels. The rings are laid on the wheels such that the nubs go through the holes in the rings and hold the rings in place. The rings are preferably reversible.

There is a ring for each wheel. Each ring is adorned with text and/or graphics that represent words, ideas, persons, places, things, and times (days, months, years, centuries, etc.). There may be several sets of rings, and rings of the same size are interchangeable.

Rather than having separate rings, the text/graphics can be applied directly to the wheels. The text/graphics can also be achieved electronically using a computer "brain" within the base (not shown) that transmits this information to the surface of the wheels.

At the center of the "G" is a hub/cap 9. The hub covers the main "locking" mechanism (e.g., a bolt 20) for the object. This locking mechanism holds the major pieces of the "G" together. This locking mechanism can be achieved in numerous ways:

Use a bolt and threaded brass insert (embedded in the base).

Use a bolt and trapped nut (using a "press fit" washer).

Use a bolt and a threaded plate held in the base with screws.

Use a plastic hub that screws directly into the plastic base.

Glue/solvent the hub to the base.

At the center of the hub/cap is a small "breakaway" cap 19 (e.g., bolt cover) to allow access to the "locking" mechanism beneath the hub. Also preferably at the center of the hub/cap is a timing device 11 (e.g., sand timer, mechanical timer, digital timer, sound timer generating one or more of various sounds, such as a heartbeat.)

Visual lineup of the text and graphics on the rings/wheels can be achieved in numerous ways:

On the top of the hub and connected to it is a "cursor" that extends out over the rings/wheels. This cursor could cantilever or be supported at the outer edge.

A small pointer 10 is attached to the hub and points in a general direction.

A small pointer or graphic is painted on the hub and points in a general direction.

If the wheels and rings are translucent or transparent, a cursor(s) is located directly beneath the under-surface of the wheels such that it can be seen through the wheels.

If the wheels and rings are translucent or transparent, LED lights are located directly beneath the under-surface of the wheels such that they can be seen through the wheels.

If the wheels and rings are translucent or transparent, light is emitted from the hub or base beneath the under-surface of the wheels, in one area, such that it can be seen through the wheels and indicates the lined up text/graphics.

A laser is emitted from the hub onto the surface of the rings/wheels.

The rings and/or wheels are adorned with radial lines between the text/graphics to aid the eye in visual lineup.

The cursor used for visual lineup can be opaque, transparent, and/or translucent. A magnifying material can be used to magnify the text/graphics. A prism-like cursor can be used to reflect the text/graphics at different angles.

Mechanical lineup, if desired, of the text and graphics on the rings/wheels can be achieved in numerous ways:

Connect a spring and "ball" mechanism to the base that "rides" in grooves in the wheels as the wheels spin.

Place magnets on the underside of the wheels directly under each text/graphic and in the base directly below these wheel magnets.

Place small "pins" on the bottom of each wheel such that they line up radially and are between each text/graphic. For each wheel, place a rubber stopper in the base that rides in line with the pins and acts to slow the wheel down. When the wheels stop, the stoppers will come to rest between the pins and will line up the text/graphics.

Place small "pins" on the sides of each wheel such that they are between each text/graphic. For each wheel, place a rubber stopper in the base such that it rides in the gap between two wheels and it rides in line with the pins and acts to slow the wheel down. When the wheels stop, the stoppers will come to rest between the pins and will line up the text/graphics.

Do not have a mechanical lineup mechanism. Rely solely on a visual lineup mechanism.

The "G" can be various shapes and materials (ex. wood, metal, plastic, cardboard, paper, etc.). The timer can also be various shapes and materials.

The hub, base, wheels and rings can be opaque, transparent, and/or translucent. The hub, base, wheels and rings can have various textures, such as highly polished, slightly textured, and varying degrees of texture.

The base and/or feet of the "G" can also take many forms:

feet molded as part of the base (one mold)

feet molded separately from the base (two molds)

- attached by push through
- attached by brass insert (in feet) and screw/washer assembly
- attached by press fit onto barbs "off the shelf" feet (pre-made)

base with no feet

- bottom of base is flat
- bottom of base is a shape that allows the object to rest in a stable, upright position on a flat surface without the base having "feet" (e.g., a cone-shaped base, where the larger end of the cone rest on the flat surface)

The ability of the wheels to spin can be achieved in numerous ways as well, such as:

Place lightweight wheels on a simple, small diameter shaft. Move each wheel up the shaft a small amount and spin it.

Place lightweight wheels on a simple, small diameter shaft. At the center of each wheel, between the shaft and the wheel, place an E-clip. Move each wheel up the shaft a small amount (if necessary) and spin it. The E-clip will allow the wheels to spin more freely.

Place an air pump in the base. Place a perforated plate/screen between the base and the wheels. Vary the number of perforations depending on the distance from the air pump. The air from the air pump will cause the wheels to ride on a cushion of air, allowing the wheels to spin freely.

Place opposing magnets in the base and in the underneath side of the wheels. The opposing magnets cause the wheels to hover above the base, allowing the wheels to spin freely.

Place grooves in the base. Place thrust bearings ("racetrack" bearings) in the grooves in the base. Place grooves on the underneath side of the wheels. As the wheels spin, they ride on the thrust bearings, which ride in the grooves. Depending on the configuration of the design, the thrust bearings could all be of the same diameter or different diameters.

Place wheel bearings 18 with axles 27 in the base (the preferred embodiment). Place grooves or protrusions (depending on shape of the wheel bearings) on the underneath side of the wheels. As the wheels spin, they ride on the wheel bearings. The bearing body is preferably a hard plastic material. The body is preferably surrounded by a pliable O-ring 26 which provides for smooth engagement with the wheels and absorption of noise during wheel spinning. The preferred material of the O-ring is clear silicone rubber having durometer of 50+/−10 measured on the Shore A scale.

The assembly of the preferred apparatus of the invention, shown in FIGS. 1–12, is such that the device can be turned sideways or upside down without disassembling. There are several preferred elements employed in the apparatus to keep it from disassembling when tipped or turned over, namely:

nesting shelves on the wheels;

grooves/protrusions on the underside of the wheels;

structural rib cutouts;

center cap; and bolt.

The nesting shelf of the middle wheel "locks" the outer wheel in place; the nesting shelf of the inner wheel "locks the middle wheel in place; the center cap "locks" the inner wheel in place and the bolt "locks" all these pieces to the base. In addition to the nested wheels, center cap and bolt, it is also the grooves and protrusions on the underside of the wheels, as well as the structural rib cutouts that act to "lock" the bearings in place. Because of the size, angle and depth of these grooves, protrusions and cutouts, the movement and rotation of the bearings are limited such that they cannot fall out of or rotate out of the slots of their respective Bearing Support Ribs 16. They are blocked in every direction by one or more of these obstructive elements. These elements collectively provide a manner of "locking" the bearings in place without an expensive add-on piece.

Furthermore, the preferred bearings silicone O-Rings of the preferred bearings prevent and absorb noise when the wheels of the apparatus are turned by a user. It is also preferred to use silicone grease on the bearing axles to reduce problems caused by imperfect axles. This silicone grease also helps to reduce noise. The preferred silicone O Rings and silicone grease also act to improve the "action" of the spinning wheels. They spin much more smoothly than they would without these two elements. Without the grease, every nick, burr and deformation of the axles and the slots they sit in/ride these imperfections, such that the axles ride smoothly. In a similar manner, the preferred O-Rings provide a pliable material between the bearing body and the underside of the wheels, reducing the effects of imperfections in both of these surfaces, such that the wheels ride smoothly on the bearings.

The text/graphics on the rings can be arranged to produce numerous versions, e.g.:

- Children's version
- Children's spaceship version
- Desktop version
- Language versions (such as English, French, German, Spanish, Chinese, Yiddish, etc.)
- English as a Second Language (ESL) version
- Romance version
- Fortune-telling version
- Ancient languages versions (such as Egyptian hieroglyphics, Mayan, Hebrew, Greek, Latin, etc.)
- Biblical version
- Graphics versions (with images)
- Graphics and text versions (with images and text)
- Historical version
- Sports version
- Food and wine version
- Weight Watchers version
- Medical version
- Astrology version
- Astronomy version
- Investments version
- Mathematical version
- Science version
- Physics version
- Animals version
- NASCAR™ version
- Hollywood version
- Legal version
- Business version
- College version
- Military version
- Theology-version
- Architecture version
- Real Estate version
- Geography version
- History version
- World History version
- US History version
- Braille version
- Phrase version
- Dramatic arts version (such as Opera, Movies, Theater, Film)
- Music version
- Travel versions (covering traveling in various countries)
- Make Your Own Rings" version
- Custom versions
- Reversible Ring versions (indicia on both sides of the ring)

In the preferred method of the invention, the following are provided to game players: One "G", two sets of word rings, one 60-second timer, 200 Scenario cards, six scratch pads, six pencils and an instruction booklet.

The following text concerning the objective of the game is preferably provided to the players: "First and foremost, Spinergy™ is a game about imagination. The objective is simple, but not always easy: create something new-a movie plot, a pickup line, a poem, even a commercial for a used-car dealership. To jump start your creative engine, you get 3 random words and a Scenario card. The rest is up to you."

The following setup is preferred: Give every player a pad and pencil. Place the timer in the center of the "G." (One can also play without the timer.) Choose a scorekeeper. Choose a player to be the first "Spinner."

The following steps are preferably given to and followed by the two or more players:

"1. When it's your turn to be the Spinner, spin the 3 wheels of the "G" in any direction. When they stop, read out loud 3 words that generally line up with the pointer (one from each wheel). The other players write down these 3 words.

"Note: If the pointer points between 2 words on a wheel, you can choose either word. If a word has occurred before, you may choose the word above or below it (on the same wheel).

"2. Draw a card from the Scenarios box and read the entire card out loud, including the point value.

"3. Start the timer. Immediately, the other players begin writing. Using the 3 words, each player must write a response that completes the scenario set up by the Scenario card (see Sample Responses).

"Note: Players must use the 3 words in the exact form as they appear on the wheels, but they can use them in any order.

"4. While the other players secretly write their responses, you secretly write down words you think they'll use in their responses. You can guess as many words as there are players, not including yourself. So, if there are a total of 5 players, you can guess 4 words.

"Hint: You're trying to guess words the other players are most likely to use, so their goal is to avoid words you're most likely to guess. Note: You can guess any words except the "Unguessable Words" listed in these instructions. Please review these now.

"5. Alert everyone when time is up.

"6. Beginning with the player on your left, each player reads (sings, etc.) his response. At the end of his response, you reveal whether he used a word on your list. Only exact words count. If he did not, he wins the points on the Scenario card. If he did, you steal the points. Reveal which word he used. Even if he used more than one word, reveal only one. Scratch the word off your list before the next player reads her response. The remaining players are free to use any scratched word. You get the points for each player who uses an unscratched word on your list.

"Note: If a player fails to use one of the 3 words or doesn't use the exact form of one of the 3 words, neither you nor the player wins any points.

"7. The scorekeeper scores points as they are won. After all players have read their responses and scores have been recorded, play passes to the left.

"8. The player with the highest score after 3 rounds wins!

"Note: One round is completed after each player has been the Spinner. You can vary the number of rounds based on the number of players and length of playing time desired."

The preferred list of "Unguessable Words" for English is as follows (the players may add others):

1. Any word used on the Scenario card in play.

2. All contractions.

3. Plus the following words: a, about, all, also, am, an, and, any, are, as, at, be, been, but, by, came, can, could, did, do, does, done, for, from, get, got, had, has, have, he, her(s), him, his, how, I, if, in, into, is, it(s), let, like, made, may, me, mine, my, no, of, oh, okay, on, once, onto, or, our(s), really, said, she, should, so, some, still, such, than, that, the, their(s), them, then, there, these, they, thing(s), this, those, to, too, uh, until, us, very, was, we, well, went, were, what, when, where, which, while, who(m), whose, why, will, with, would, yes, you, and your(s).

The following examples show how the method of the invention may be employed to engage in storytelling activities, particularly in accordance with the above instructions:

EXAMPLE 1

3 words: decoy, karate, refrigerator

Scenario: It's All About Me—Read an enthralling adventure from your autobiography.

Response: "As my refrigerator advanced menacingly, I assumed a fighting karate stance. It was then that I realized the fridge was a decoy and it was the stove behind me I should worry about."

EXAMPLE 2

3 words: pyramids, east, measure Scenario: Riddle Me This—create a riddle: a mystifying, misleading, or puzzling question posed as a problem to be solved or guessed.

Response: "The pyramids hold treasure, for those who can measure, the distance from east to west."

EXAMPLE 3

3 words: cafe, caribou, lawyer

Scenario: Limerick—create a Limerick: a humorous or nonsensical verse of five lines with the rhyme scheme a-a-b-b-a.

Response: "There once was a lawyer who liked to sue.

He ate lunch at a cafe in Waterloo.

When he refused to eat goose, and was served up a moose, cried "I object! I ordered a caribou!"

EXAMPLE 4

3 words: cactus, vanish, captain

Scenario: Tongue-Tied—Create a tongue twister.

Response: "Can the clever captain keep concealed behind the cactus to capture the vain, velcro™ villain before she can vanish victoriously?"

EXAMPLE 5

3 words: pickled, sneeze, mosquito

Scenario: Poetic Resignation—You are the poet-in-residence for a publishing house that sells children's books. Compose a rhyming letter in which you resign from your job.

Response: "I do not like to write kids' books,
I'd rather hang them all on hooks.
I will not write about a crow,
a dog, a horse, or mosquito.
I will not with this hat I'm wearing,
nor while I'm eating pickled herring.
I will not write them if you please,
the rhyming drivel makes me sneeze.
I do not like them, not one bit!
That is why I quit, quit, quit!"

An alternative method, named "Reverse Spinergy!", follows the same instructions except that the Spinner is the only player who creates a response. The other players each secretly guess a word the Spinner will use in her response. After the Spinner gives her response, each player reveals whether the Spinner used his guessed word. Each player who correctly guessed a word receives the point value of the Scenario card. For each player who did not correctly guess a word, the Spinner receives the point value of the Scenario card.

Another alternative method, named "Spontaneous Spinergy!", follows the same instructions except that after the Spinner chooses 3 words, but before the Scenario card is read, the other players each guess a word the Spinner will use in her response. The Spinner then draws a Scenario card and reads it out loud. Immediately, the timer is started. The Spinner must create and give her response preferably within 60 (alternatively, 30) seconds. If the Spinner does not finish in the allotted time, using all 3 words, no points are scored and play passes to the left.

An additional alternative method, named "Brainstorm Spinergy!", employs the "G" and collective imaginations to create a plot, characters and scenes. The players are then encouraged to employ a video camera to produce a video. Similarly, the players can write a song and make a music video.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A concentric-ring apparatus comprising:

a hub;

a plurality of concentric wheels mounted around and spinnable about said hub;

indicia on said wheels; and a timer mounted atop said hub.

2. The apparatus of claim 1 wherein each of said wheels comprises one or more finger notches.

3. The apparatus of claim 1 additionally comprising rings removably attached to said wheels on which are attached said indicia.

4. The apparatus of claim 1 additionally comprising a base comprising a plurality of bearings over which said wheels travel, said bearings comprising O-rings of a pliable material.

5. The apparatus of claim 4 wherein said pliable material comprises silicone.

6. The apparatus of claim 4 additionally comprising means for preventing said apparatus from disassembling when said apparatus is tipped or inverted.

7. The apparatus of claim 1 wherein said timer is a sand timer.

8. A concentric-ring apparatus comprising:

a hub;

a plurality of concentric wheels mounted around and spinnable about said hub;

a base; and a plurality of bearings mounted in said base and over which said wheels travel, said bearings comprising O-rings of a flexible material.

9. The apparatus of claim 8 wherein each of said wheels comprises one or more finger notches.

10. The apparatus of claim 8 wherein said flexible material comprises silicone.

11. The apparatus of claim 8 additionally comprising means for preventing said apparatus from disassembling when said apparatus is tipped or inverted.

12. The apparatus of claim 8 additionally comprising indicia on said wheels.

13. The apparatus of claim 8 additionally comprising a timer mounted atop said hub.

14. The apparatus of claim 13 wherein said timer is a sand timer.

* * * * *